US008531125B2

(12) United States Patent
Kim et al.

(10) Patent No.: US 8,531,125 B2
(45) Date of Patent: Sep. 10, 2013

(54) BACKLIGHT ASSEMBLY, AND DISPLAY APPARATUS AND TELEVISION COMPRISING THE SAME

(75) Inventors: Tae-sung Kim, Suwon-si (KR); Young-deok Choi, Seoul (KR); Hyo-soon Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 381 days.

(21) Appl. No.: 12/887,713

(22) Filed: Sep. 22, 2010

(65) Prior Publication Data

US 2011/0075057 A1 Mar. 31, 2011

(30) Foreign Application Priority Data

Sep. 30, 2009 (KR) ..... 10-2009-0093237

(51) Int. Cl.
*H05B 41/16* (2006.01)
*G05F 1/00* (2006.01)

(52) U.S. Cl.
USPC ..... 315/279; 315/291

(58) Field of Classification Search
USPC ..... 315/276–277, 279, 282, 312, 185 R, 315/185 S, 291, 307
See application file for complete search history.

(56) References Cited

U.S. PATENT DOCUMENTS

| | | | | |
|---|---|---|---|---|
| 7,042,171 | B1 * | 5/2006 | Lin | 315/291 |
| 7,196,483 | B2 * | 3/2007 | Wey et al. | 315/312 |
| 7,291,987 | B2 * | 11/2007 | Chang et al. | 315/282 |
| 7,439,685 | B2 * | 10/2008 | Kim et al. | 315/277 |
| 7,477,023 | B2 * | 1/2009 | Shimura et al. | 315/282 |
| 7,492,106 | B2 * | 2/2009 | Sengoku et al. | 315/276 |
| 2006/0284569 | A1 | 12/2006 | Wey et al. | |
| 2008/0129300 | A1 * | 6/2008 | Ger et al. | 324/414 |
| 2009/0160350 | A1 | 6/2009 | Liu et al. | |
| 2009/0189842 | A1 * | 7/2009 | Huang et al. | 345/102 |

FOREIGN PATENT DOCUMENTS

| | | | |
|---|---|---|---|
| EP | 2 237 645 | A1 | 10/2010 |
| EP | 2 278 857 | A2 | 1/2011 |
| KR | 10-2007-0096242 | A | 10/2007 |
| KR | 10-2008-0071411 | A | 8/2008 |

OTHER PUBLICATIONS

European Search Report, dated Feb. 24, 2011, issued in Application No. 10175927.2.

* cited by examiner

*Primary Examiner* — Minh D A

(74) *Attorney, Agent, or Firm* — Sughrue Mion, PLLC

(57) ABSTRACT

A backlight assembly including: a power unit which outputs a current whose polarity is changed on a regular basis; a plurality of balancing units which is connected in parallel to the power unit; a plurality of light emitting diode (LED) modules each of which individually receives each current output by a corresponding balancing unit of the plurality of balancing units; and a driver which is connected between the plurality of balancing units and the plurality of LED modules, and forms a current route for each balancing unit included in the plurality of balancing units to balance a current supplied to two different LED modules during a single period where a polarity of a current output by the power unit is changed.

19 Claims, 9 Drawing Sheets

BACKLIGHT ASSEMBLY, AND DISPLAY APPARATUS AND TELEVISION COMPRISING THE SAME

CROSS-REFERENCE TO RELATED APPLICATION

This application claims priority from Korean Patent Application No. 10-2009-0093237, filed on Sep. 30, 2009 in the Korean Intellectual Property Office, the disclosure of which is incorporated herein by reference.

BACKGROUND

1. Field

Aspects of the present inventive concept relate to a backlight assembly, and a display apparatus and a television comprising the same, and more particularly, to a backlight assembly, and a display apparatus and a television comprising the same which includes a light emitting diode (LED).

2. Description of the Related Art

In recent years, flat display devices, such as a liquid crystal display (LCD), a plasma display panel (PDP) and an organic light emitting diode (OLED), have increasingly replaced cathode ray tubes (CRT).

As a liquid crystal panel of the LCD does not emit light itself, the LCD has a backlight unit in a rear side thereof to receive light. Transmittance of light that is emitted by the backlight unit is adjusted by arrangement of liquid crystals. The liquid crystal display panel and the backlight unit are accommodated in an accommodating member, such as a chassis. A light source which is used in the backlight unit may include a linear light source, such as a lamp, and a point light source, such as a light emitting diode (LED). Among them, the LED has drawn a lot of attention recently.

A power driver, which changes a state of input power and supplies the power to the light source, is normally divided into several blocks. In accordance with the upsizing of the display apparatus, the number of light sources included in the backlight unit increases as well as the number of power drivers. As a result, the configuration of the display apparatus becomes complicated.

SUMMARY

Accordingly, aspects of the present inventive concept provide a backlight assembly, and a display apparatus and a television comprising the same which is more efficient and slimmer. Also, aspects of the present inventive concept provide a backlight assembly, and a display apparatus and a television comprising the same which has a simple control configuration. Further, aspects of the present inventive concept provide a backlight assembly, and a display apparatus and a television comprising the same which reduces manufacturing costs by decreasing the number of components used.

Additional aspects and/or advantages of the present inventive concept will be set forth in part in the description which follows and, in part, will be obvious from the description, or may be learned by practice of the present inventive concept.

According to an aspect of the present inventive concept, there is provided a backlight assembly including: a power unit which outputs a current whose polarity is changed on a regular basis; a plurality of balancing units which is connected in parallel to the power unit; a plurality of light emitting diode (LED) modules each of which individually receive the respective current output by a corresponding balancing unit of the plurality of balancing units; and a driver which is connected between the plurality of balancing units and the plurality of LED modules, and which forms a current route for each of the plurality of balancing units to balance the current supplied to two different LED modules during a single period where the polarity of the current output by the power unit is changed.

The current which is supplied to the plurality of LED modules may be equally balanced during the single period where the polarity of the current output by the power unit is changed.

The power unit may include: a power factor compensator which compensates for a power factor of primitive power; an inverter which converts a direct current whose power factor is compensated for by the power factor compensator into an alternating current; and a transformer which transforms the alternating current as a primary current into a secondary current.

The plurality of balancing units may each include a balancing capacitor which is connected to at least one end of a secondary coil included in the transformer.

The driver may include: a first diode line which forms a first current route supplying a current output by a first end of the transformer to a first LED module if the current output by the power unit is positive; and a second diode line which forms a second current route supplying a current output by a second end of the transformer to a second LED module if the current output by the power unit is negative.

The inverter may include a half bridge type or a full bridge type.

The plurality of balancing units may be connected in parallel to a single secondary coil included in the transformer.

The plurality of balancing units may be connected to a plurality of secondary coils included in the transformer.

The backlight assembly may further include a driving controller which detects the current flowing in the plurality of LED modules, and generates a control signal to control the detected current to become a predetermined reference current and outputs the control signal to the power unit.

The driving controller may perform a variable frequency control or a fixed frequency control.

According to another aspect of the present inventive concept, there is provided a display apparatus including: a liquid crystal display (LCD) panel which displays an image thereon; and a backlight assembly which emits light to the LCD panel, the backlight assembly including: a power unit which outputs a current whose polarity is changed on a regular basis; a plurality of balancing units which is connected in parallel to the power unit; a plurality of LED modules each of which individually receives the current output by a corresponding balancing unit of the plurality of balancing units; and a driver which is connected between the plurality of balancing units and the plurality of LED modules, and forms a current route for each balancing unit to balance a current supplied to two different LED modules during a single period where the polarity of the current output by the power unit is changed.

The current supplied to the plurality of LED modules may be equally balanced during the single period where the polarity of the current output by the power unit is changed.

The power unit may include: a power factor compensator which compensates for a power factor of primitive power; an inverter which converts a direct current whose power factor is compensated for by the power factor compensator into an alternating current; a transformer which transforms the alternating current as a primary current into a secondary current; and the plurality of balancing units may each include a balancing capacitor which is connected to at least a first end of a secondary coil included in the transformer.

The driver may include: a first diode line which forms a first current route supplying a current output by a first end of the transformer to a first LED module if the current output by the power unit is positive; and a second diode line which forms a second current route supplying a current output by a second end of the transformer to a second LED module if the current output by the power unit is negative.

According to another aspect of the present inventive concept, there is provided a television, including: a broadcasting receiver which receives a broadcasting signal; a signal processor which processes the received broadcasting signal; a liquid crystal display (LCD) panel which displays the processed broadcasting signal thereon; a backlight assembly which emits light to the LCD panel, the backlight assembly including: a power unit which outputs a current whose polarity is changed on a regular basis; a plurality of balancing units which is connected in parallel to the power unit; a plurality of light emitting diode (LED) modules each of which individually receive the current output by a corresponding balancing unit of the plurality of balancing units; and a driver which is connected between the plurality of balancing units and the plurality of LED modules, and forms a current route for each balancing unit to balance a current supplied to two different LED modules during a single period where a polarity of the current output by the power unit is changed.

The current supplied to the plurality of LED modules may be equally balanced during the single period where the polarity of the current output by the power unit is changed.

The power unit may include: a power factor compensator which compensates for a power factor of primitive power; an inverter which converts a direct current whose power factor is compensated for by the power factor compensator into an alternating current; and an insulating transformer which transforms the alternating current as a primary current into a secondary current.

The plurality of balancing units may each include a balancing capacitor which is connected to at least a first end of a secondary coil included in the insulating transformer.

The driver may include: a first diode line which forms a first current route supplying a current output by a first end of the transformer to a first LED module if the current output by the power unit is positive; and a second diode line which forms a second current route supplying a current output by a second end of the insulating transformer to a second LED module if the current output by the power unit is negative.

BRIEF DESCRIPTION OF THE DRAWINGS

The above and/or other aspects of the present inventive concept will become apparent and more readily appreciated from the following description of the exemplary embodiments, taken in conjunction with the accompanying drawings of which.

DETAILED DESCRIPTION OF EXEMPLARY EMBODIMENTS

Hereinafter, exemplary embodiments of the present inventive concept will be described with reference to accompanying drawings, wherein like numerals refer to like elements and repetitive descriptions will be avoided as necessary.

Figure 1:
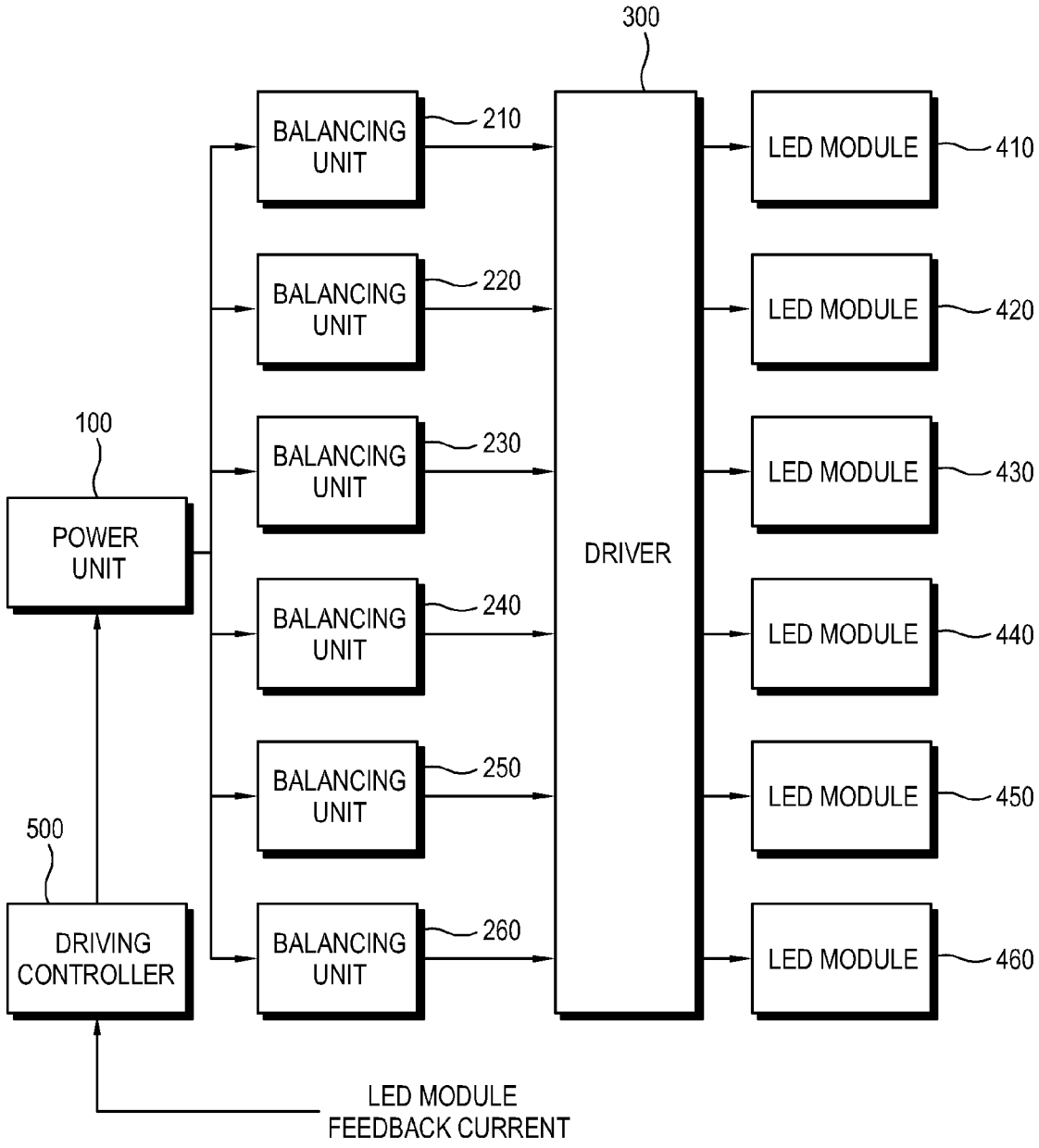
FIG. 1 is a control block diagram of a backlight assembly according to an exemplary embodiment of the present inventive concept.
Figure 2:
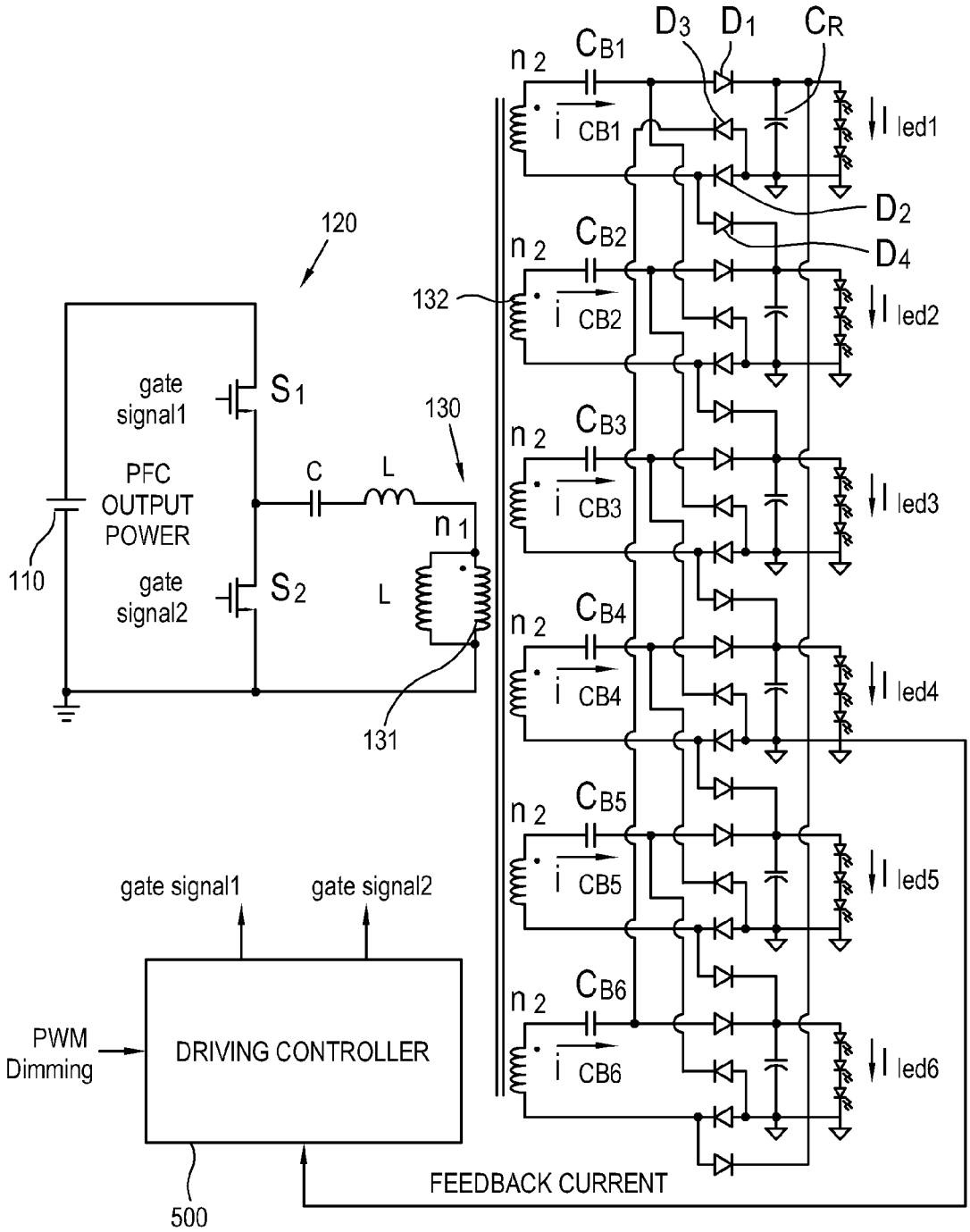
FIG. 2 is a circuit diagram of the backlight assembly in FIG. 1.

FIG. 1 is a control block diagram of a backlight assembly according to an exemplary embodiment of the present inventive concept. FIG. 2 is a circuit diagram of the backlight assembly in FIG. 1. As shown therein, the backlight assembly includes a power unit 100, a plurality of balancing units 210, 220, 230, 240, 240, 250 and 260, a plurality of light emitting diode (LED) modules 410, 420, 430, 440, 450 and 460 corresponding to the number of the plurality of balancing units 210, 220, 230, 240, 240, 250 and 260, a driver 300 to drive the plurality of LED modules 410, 420, 430, 440, 450 and 460, and a driving controller 500 to control a current supplied to the LED modules 410, 420, 430, 440, 450 and 460.

The power unit 100 outputs a current whose polarity is changed on a regular basis. That is, the power unit 100 outputs a sine wave or square wave current, whose polarity is changed from positive to negative and vice versa, to the plurality of balancing units 210, 220, 230, 240, 240, 250 and 260. The power unit 100 according to the present exemplary embodiment includes a power factor compensator 110, an inverter 120, and a transformer 130 which is connected to the inverter 120.

The power factor compensator 110 converts primitive power (i.e., input commercial AC power) into DC power, and compensates for a power factor of the converted DC power. The power factor compensator 110 may include a rectifying circuit to convert AC power into DC power. DC power which is output by the power factor compensator 110 may present a voltage level ranging from 200V to 400V. FIG. 2 illustrates power which is output by the power factor compensator 110. If a voltage level of primitive power is below approximately 75V, the power factor compensator 110 may be omitted. That is, the power factor compensator 110 may be omitted depending on the voltage level of the primitive power and product standards.

The inverter 120 includes a plurality of switching elements S1 and S2 and resonance circuits C and L which convert input DC current into AC current. The inverter 120 is a half bridge which includes a first switching element S1 and a second switching element S2. Polarity of the current input to the transformer 130 is changed to the opposite when the first switching element S1 is turned on and the second switching element S2 is turned off and when the first switching element S1 is turned off and the second switching element S2 is turned on.

The transformer 130 converts a primary current output by the inverter 120 (i.e., an alternating current) into a secondary current. The transformer 130 may include an insulating transformer or a non-insulating transformer. If the transformer 130 includes an insulating transformer, the transformer 130 may protect the circuit from high voltage or high current generated by a ground loop or a line surge and stably drive the backlight assembly. The transformer 130 includes a plurality of secondary coil 132, and each of the secondary coils 132 is respectively connected to corresponding balancing units 210, 220, 230, 240, 240, 250 and 260. The number of turns of the plurality of secondary coils 132 may be equal to thereby substantially induct the same current into the balancing units 210, 220, 230, 240, 240, 250 and 260. A winding ratio of the primary coils 131 and the secondary coils 132 of the transformer 130 (i.e., the ratio of coils) is n1:n2, and the current which is inducted into the secondary coils 132 is adjusted to different levels according to the ratio of coils.

The plurality of balancing units 210, 220, 230, 240, 240, 250 and 260 is connected in parallel to the power unit 100, and more specifically, to the plurality of secondary coils 132 of the transformer 130. The balancing units 210, 220, 230, 240, 240, 250 and 260 include balancing capacitors CB1, CB2, CB3, CB4, CB5 and CB6 which are connected to at least a first end of the secondary coils 132. The balancing capacitors CB1, CB2, CB3, CB4, CB5 and CB6 may additionally be connected to a second end of the secondary coils 132. The balancing units 210, 220, 230, 240, 240, 250 and 260 balance a current supplied to the LED modules 410, 420, 430, 440, 450 and 460 and adjust a current to be supplied equally to the LED modules 410, 420, 430, 440, 450 and 460.

The plurality of LED modules 410, 420, 430, 440, 450 and 460 individually receive a current output by the plurality of balancing units 210, 220, 230, 240, 240, 250 and 260. That is, the plurality of LED modules 410, 420, 430, 440, 450 and 460 may correspond to the plurality of balancing units 210, 220, 230, 240, 240, 250 and 260 in a one-to-one ratio. The LED modules 410, 420, 430, 440, 450 and 460 include a plurality of LEDs and power supply is controlled by unit of the LED modules 410, 420, 430, 440, 450 and 460.

The driver 300 is connected between the plurality of balancing units 210, 220, 230, 240, 240, 250 and 260 and the plurality of LED modules 410, 420, 430, 440, 450 and 460, and forms a current route for the balancing capacitors CB1, CB2, CB3, CB4, CB5 and CB6 included in the plurality of balancing units 210, 220, 230, 240, 240, 250 and 260 to balance a current supplied to two different LED modules during a single period where a polarity of the current output by the power unit 100 is changed. The detailed configuration of the driver 300 will be described later.

The driving controller 500 generates a control signal to control a current flowing in the LED modules 410, 420, 430, 440, 450 and 460 to be a preset reference current based on a fed-back current flowing in the LED modules 410, 420, 430, 440, 450 and 460. As shown, a gate signal 1 and a gate signal 2 are output by the driving controller 500 to the switching elements S1 and S2 of the power unit 100. A reference current corresponds to a brightness of the LED modules 410, 420, 430, 440, 450 and 460, and may be set and changed by a user. The driving controller 500 may output a control signal through a variable frequency control or a fixed frequency control. A control method of the driving controller 500 may include any of various methods known in the art.

Typically, a power driver, which supplies driving power to a light source of the backlight assembly, includes several blocks. For example, the power driver may be classified into a block which converts AC power into DC power, a converter block which converts DC power into a voltage at a consistent level and a light source driver block which adjusts a consistent voltage and supplies a current at a consistent level to the light source. In this case, input power should go through the three blocks to be finally supplied to the light source unit, and the nature of the power is changed while going through each block. Efficiency decreases when the power goes through a single block and the final efficiency of power which has gone through three blocks is approximately 73% even if power efficiency for each block is 90%. That is, as at least 27% is consumed as heat, and there arises a problem due to the heat. As the number of light sources increase, blocks which supply driving power also increase, thereby adversely affecting downsizing of the backlight assembly.

According to the present exemplary embodiment, power which is output by the power factor compensator 110 is controlled by only the driving controller 500. Elements which are included in the inverter 120 and the driver 300 are passive elements and do not require an additional control. That is, the backlight assembly includes a first block which includes the power factor compensator 110 and a second block which includes a power conversion block and a light source driver block, rather than three power blocks which need three controls. Reduction of control circuits results in simplified control, increased efficiency in driving, and reduced manufacturing costs. The heating problem of the backlight assembly is improved and the backlight assembly is downsized by the reduced power blocks.

The driver 300 includes a rectifying capacitor CR which is connected in parallel to the LED modules 410, 420, 430, 440, 450 and 460 and a sub driver which includes four diodes D1, D2, D3 and D4. As shown therein, the sub driver is connected to the LED modules 410, 420, 430, 440, 450 and 460 and symmetrical to each other. The first diode D1 is connected between the balancing capacitor CB1 and the rectifying capacitor CR. The second diode D2 is connected between the ground and a second end of the secondary coils 132. The third diode D3 is connected between a node of the balancing capacitor CB1 and the first diode D1 and the ground, and the fourth diode D4 is connected between a node and an output terminal of the first diode D1 included in the adjacent sub driver, the node being between the second end of the secondary coils 132 and the second diode D2. The first diode D1, the rectifying capacitor CR and the second diode D2 form a first current route while the fourth diode D4, the rectifying capacitor CR and the third diode D3 form a second current route.

Figure 3:
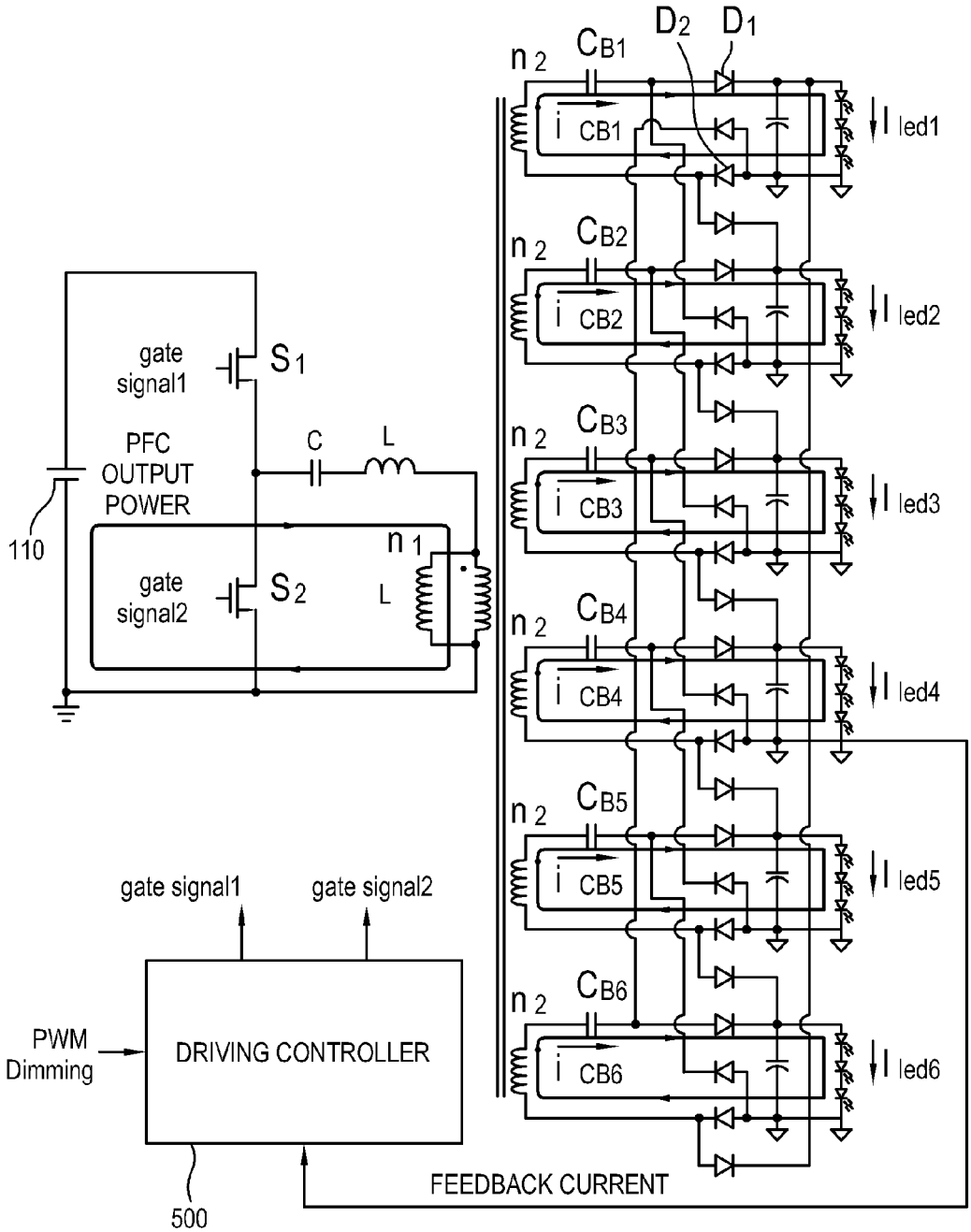
FIG. 3 illustrates a current route in accordance with the circuit diagram in FIG. 2.

FIG. 3 illustrates the first current route which is formed when a positive current is output by the power unit 100. If the first switching element S1 of the inverter 120 is turned on and if the second switching element S2 is turned off, a direct current which is input to both ends of the inverter 120 becomes a high level and a positive current flows clockwise after going through the capacitor C and the inductor L. The current is inducted into the secondary coils 132 by the transformer 130, and supplied to the LED modules 410, 420, 430, 440, 450 and 460 through the balancing capacitors CB1, CB2, CB3, CB4, CB5 and CB6 and the first diode D1. The rectifying capacitor CR reduces an AC component from the current. Thus, the current becomes DC power at a consistent level whose ripple has been removed. The LED modules 410, 420, 430, 440, 450 and 460 emit light in proportion to the current applied. Currents iCB1, iCB2, iCB3, iCB4, iCB5 and iCB6 which have gone through the LED modules 410, 420, 430, 440, 450 and 460 are transmitted to the secondary coils 132 through the second diode D2. In sum, when a positive current is output by the power unit 100, the first current loop is formed by the secondary coils 132, the balancing capacitors CB1, CB2, CB3, CB4, CB5 and CB6, the first diode D1, the LED modules 410, 420, 430, 440, 450 and 460, the second diode D2, and the secondary coils 132. An average current iCB1 which flows in the first balancing capacitor CB1 becomes a current Iled1 flowing in the first LED module 410, and an average current iCB2 which flows in a second balancing capacitor CB2 becomes a current Iled2 flowing in the second LED module 420, and an average current which flows in an Nth balancing capacitor becomes a current flowing in an Nth LED module.

Figure 4:
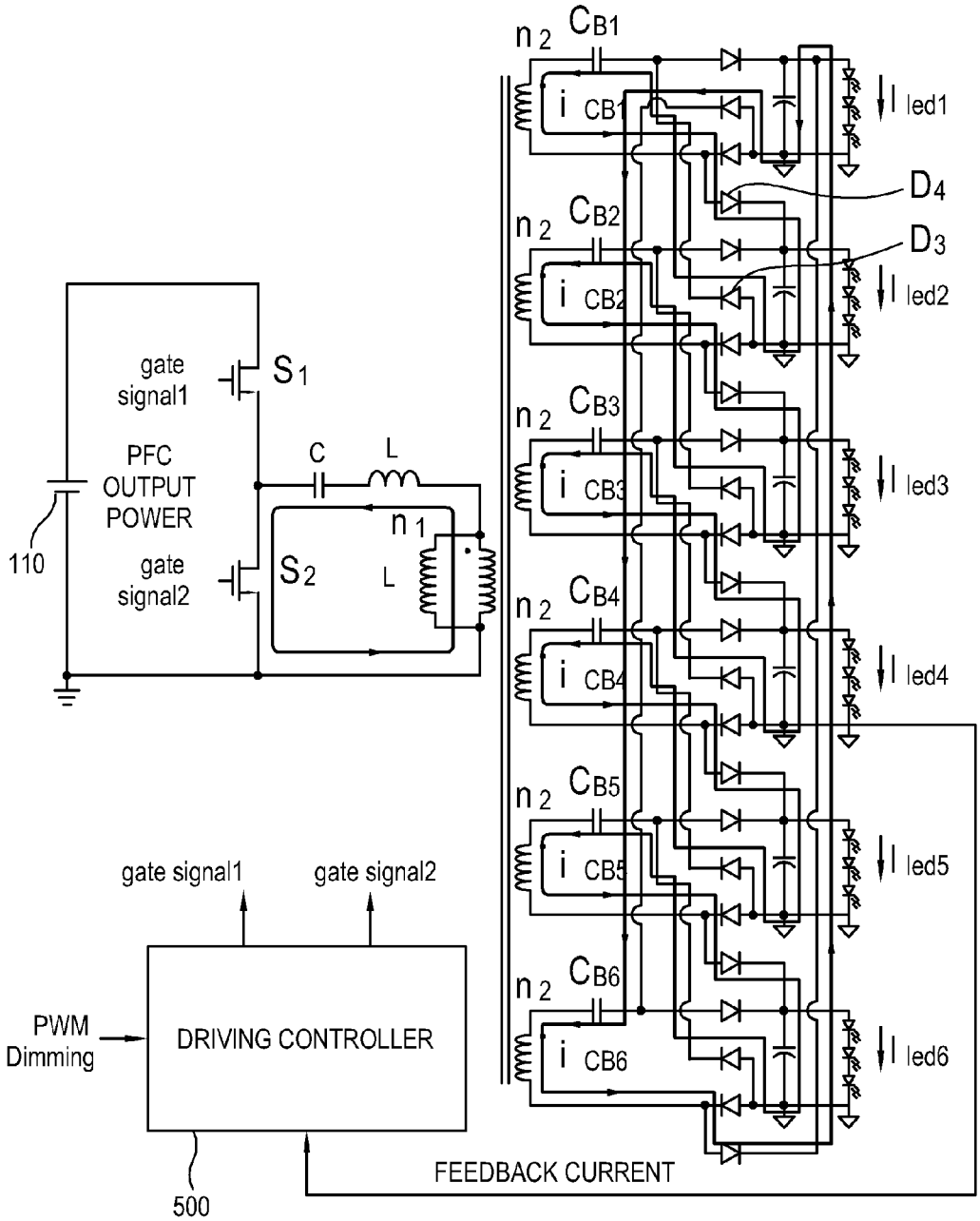
FIG. 4 illustrates another current route in accordance with the circuit diagram in FIG. 2.

FIG. 4 illustrates the second current route which is formed when a negative current is output by the power unit 100. If the first switching element S1 of the inverter 120 is turned off and if the second switching element S2 is turned on, a direct current which is input to both ends of the inverter 120 becomes a low level and a negative current flows counterclockwise after going through the inductor L and the capacitor C. The current is inducted into the secondary coils 132 by the transformer 130, and supplied to the adjacent LED modules 410, 420, 430, 440, 450 and 460 provided in a lower end through the fourth diode D4. Currents iCB1, iCB2, iCB3, iCB4, iCB5 and iCB6 which have gone through the adjacent LED modules 410, 420, 430, 440, 450 and 460 are transmitted back to the secondary coils 132 through the third diode D3 and the balancing capacitors CB1, CB2, CB3, CB4, CB5 and CB6. In sum, when a negative current is output by the power unit 100, the second current loop is formed by the secondary coils 132, the fourth diode D4, the adjacent LED modules 410, 420, 430, 440, 450 and 460, the third diode D3, the balancing capacitors CB1, CB2, CB3, CB4, CB5 and CB6 and the secondary coils 132. An average current iCB1 which flows in the first balancing capacitor CB1 becomes a current Iled2 flowing in the second LED module 420, and an average current iCB2 which flows in the second balancing capacitor CB2 becomes a current Iled3 flowing in the third LED module 430, and an average current iCBN which flows in an Nth balancing capacitor 460 becomes a current Iled1 flowing in the first LED module 410.

If a sine wave current is input to the balancing capacitors CB1, CB2, CB3, CB4, CB5 and CB6, an average current iCB1, iCB2, iCB3, iCB4, iCB5 and iCB6 flowing in the balancing capacitors CB1, CB2, CB3, CB4, CB5 and CB6 during a single period becomes zero by charge and discharge of the balancing capacitors CB1, CB2, CB3, CB4, CB5 and CB6. When the average current iCB1 becomes zero during a single period, the current Iled1 flowing in the first LED module 410 is the same as a current Iled2 flowing in the second LED module 420. Likewise, the current Iled2 flowing in the second LED module 420 becomes equal to the current Iled3 flowing in the third LED module 430 during a single period since the average current iCB2 flowing in the second capacitor CB2 becomes zero during a single period. Similarly, the current Iled6 flowing in the sixth LED module 460 becomes equal to the current Iled1 flowing in the first LED module 410 during a single period by the sixth balancing capacitor CB6 connected lastly. As a result, the currents which flow in all of the LED modules 410, 420, 430, 440, 450 and 460 during a single period are balanced equally.

To equally balance the current flowing in the N number of LED modules, the driver 300 includes the N number of balancing capacitors. Furthermore, a current route is formed to have the current flow in each half from the balancing capacitors to the two LED modules 410 and 420, 420 and 430, 430 and 440, 440 and 450, 450 and 460, and 460 and 410. Since the current balancing of the LED modules 410, 420, 430, 440, 450 and 460 may be accomplished by only the balancing capacitors CB1, CB2, CB3, CB4, CB5 and CB6, power efficiency of driving the LED modules CB1, CB2, CB3, CB4, CB5 and CB6 may be improved, and the overall size of the backlight assembly and the manufacturing costs may be reduced.

The current balancing which uses the sine curve may balance the current flowing in the LED modules 410, 420, 430, 440, 450 and 460 regardless of an impedance of the balancing capacitors CB1, CB2, CB3, CB4, CB5 and CB6 and the diodes D1, D2, D3 and D4 and an impedance of the LED modules 410, 420, 430, 440, 450 and 460.

Figure 5:
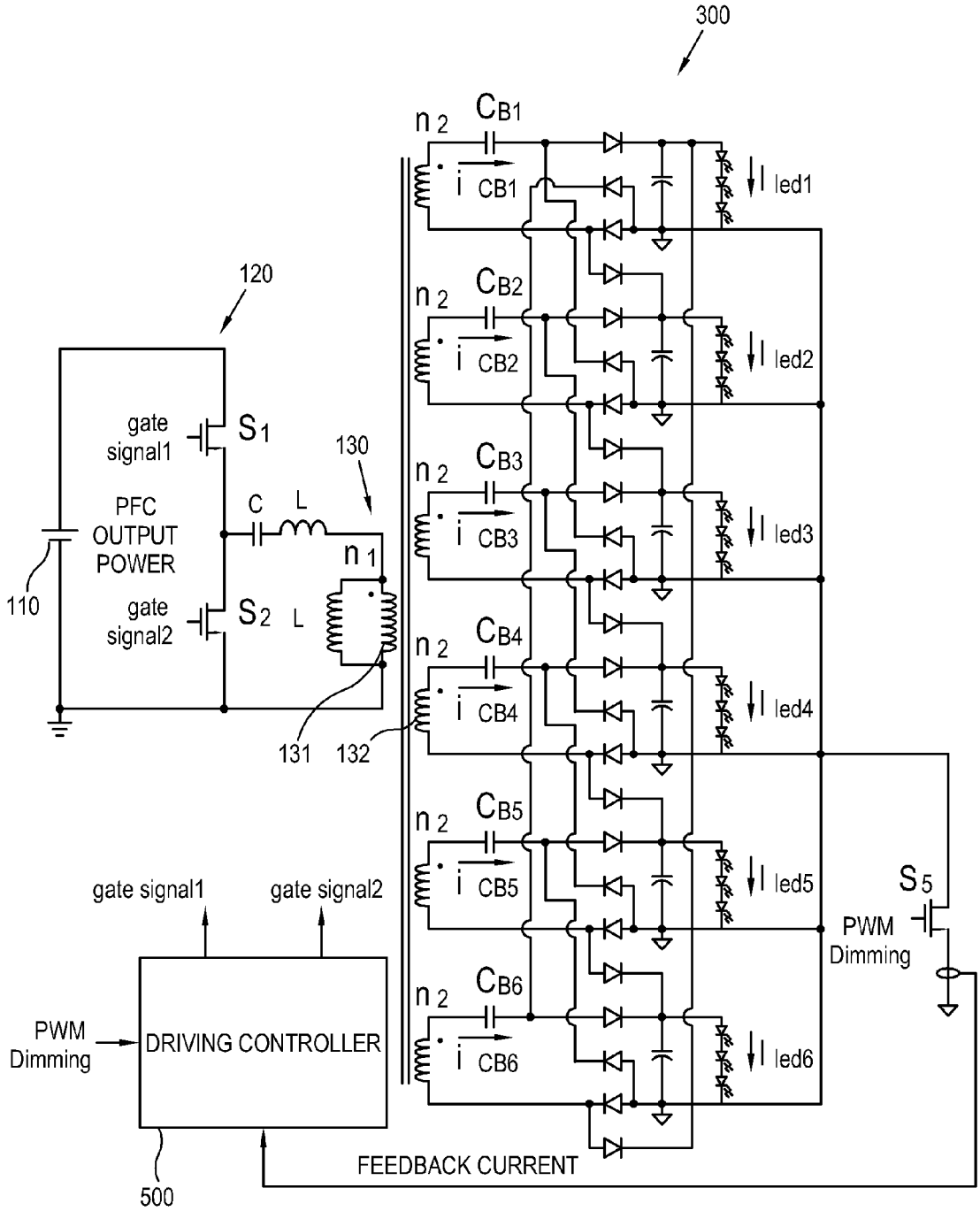
FIG. 5 is a circuit diagram of a backlight assembly according to another exemplary embodiment of the present inventive concept.

FIG. 5 is a circuit diagram of a backlight assembly according to another exemplary embodiment of the present inventive concept. Referring to FIG. 5, the driver 300 further includes a fifth switching element S5 which applies a pulse width modulation (PWM) dimming signal to the LED modules 410, 420, 430, 440, 450 and 460. The PWM dimming signal which is applied to the fifth switching element S5 is the same as a PWM dimming signal input to the driving controller 500. If power supplied to the LED modules 410, 420, 430, 440, 450 and 460 should be cut off (i.e., if the LED modules 410, 420, 430, 440, 450 and 460 should be turned off), the LED modules 410, 420, 430, 440, 450 and 460 may not be immediately turned off due to a delay time where the PWM dimming signal is transmitted to the LED modules 410, 420, 430, 440, 450 and 460. Likewise, turn-on timing of the LED modules 410, 420, 430, 440, 450 and 460 may also be delayed. Accordingly, to turn on and off the LED modules 410, 420, 430, 440, 450 and 460 quickly and accurately, the PWM dimming signal is also applied to a first end of the LED modules 410, 420, 430, 440, 450 and 460.

Figure 6:
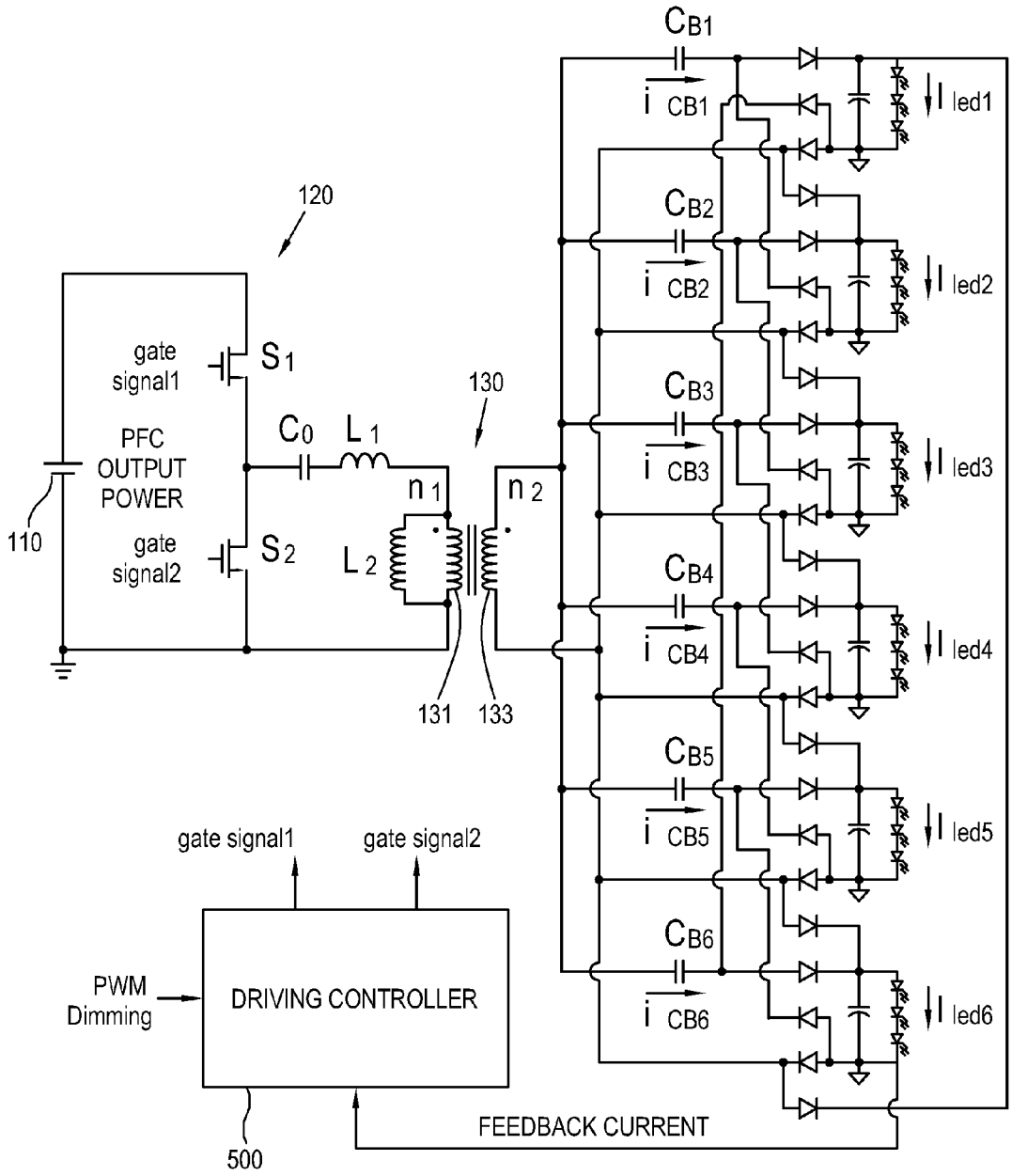
FIG. 6 is a circuit diagram of a backlight assembly according to another exemplary embodiment of the present inventive concept.

FIG. 6 is a circuit diagram of a backlight assembly according to another exemplary embodiment of the present inventive concept. Referring to FIG. 6, the transformer includes primary coils 131 and a secondary coil 133. The plurality of balancing capacitors CB1, CB2, CB3, CB4, CB5 and CB6 is connected in parallel to the secondary coil 133. The current route of the balancing capacitors CB1, CB2, CB3, CB4, CB5 and CB6 and the LED modules 410, 420, 430, 440, 450 and 460 may be easily recognized by one of ordinary skill in the art, and a repetitive description thereof is omitted herein.

It is understood that the relationship between the secondary coil 132 and 133 and the primary coil 131 is not limited in all aspects of the present inventive concept to those shown in FIGS. 2 and 6, and may vary as long as the coils induct a current into the balancing capacitors CB1, CB2, CB3, CB4, CB5 and CB6.

Figure 7:
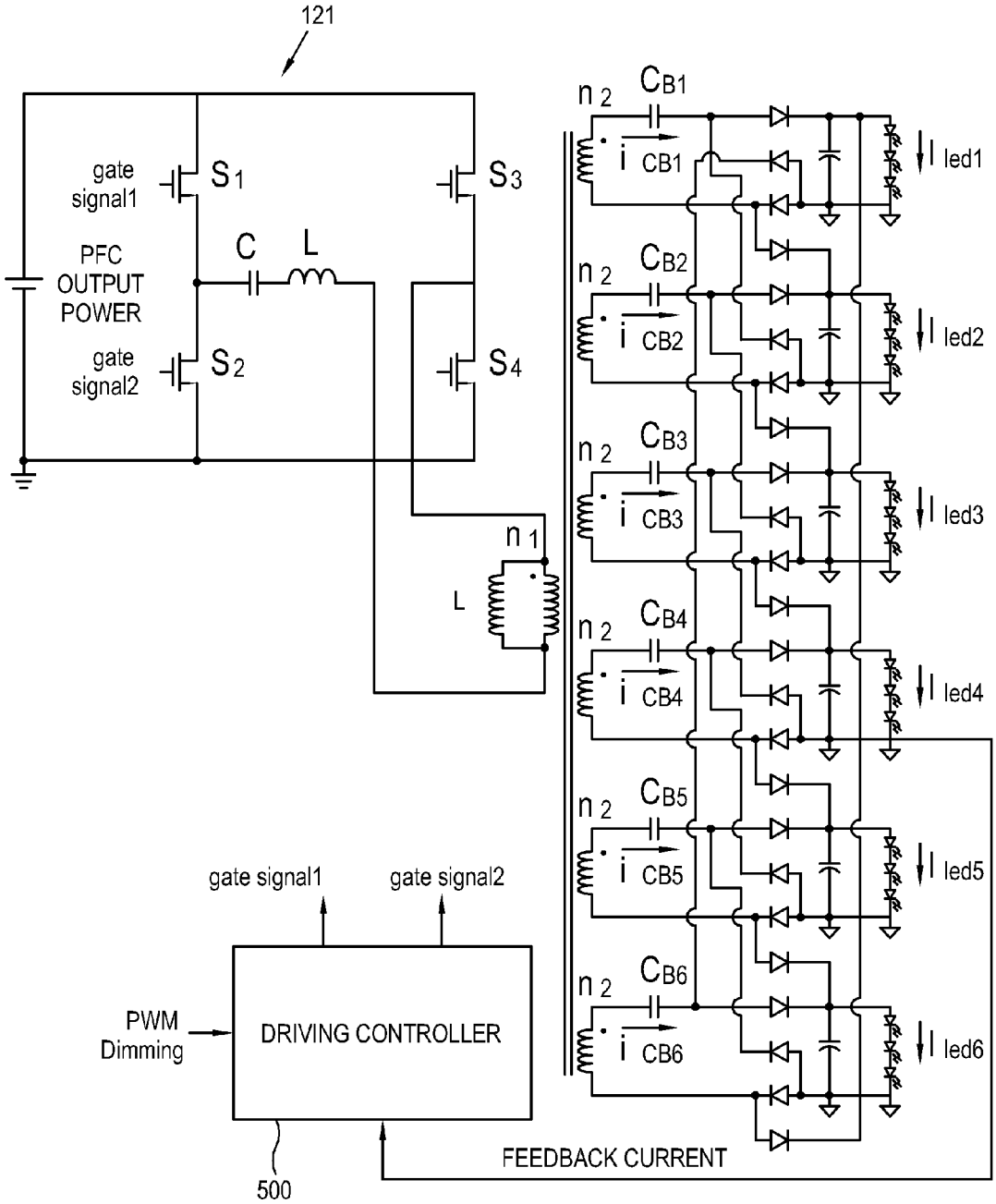
FIG. 7 is a circuit diagram of a backlight assembly according to another exemplary embodiment of the present inventive concept.

FIG. 7 is a circuit diagram of a backlight assembly according to another exemplary embodiment of the present inventive concept. Referring to FIG. 7, the inverter 121 includes a full bridge rather than a half bridge. The full bridge type includes four switching elements S1, S2, S3 and S4. The inverter 121 may include a resonance circuit which includes a capacitor C and an inductor L. The inverter 121 is not limited to that shown in the drawings and may include various known circuits.

Figure 8:
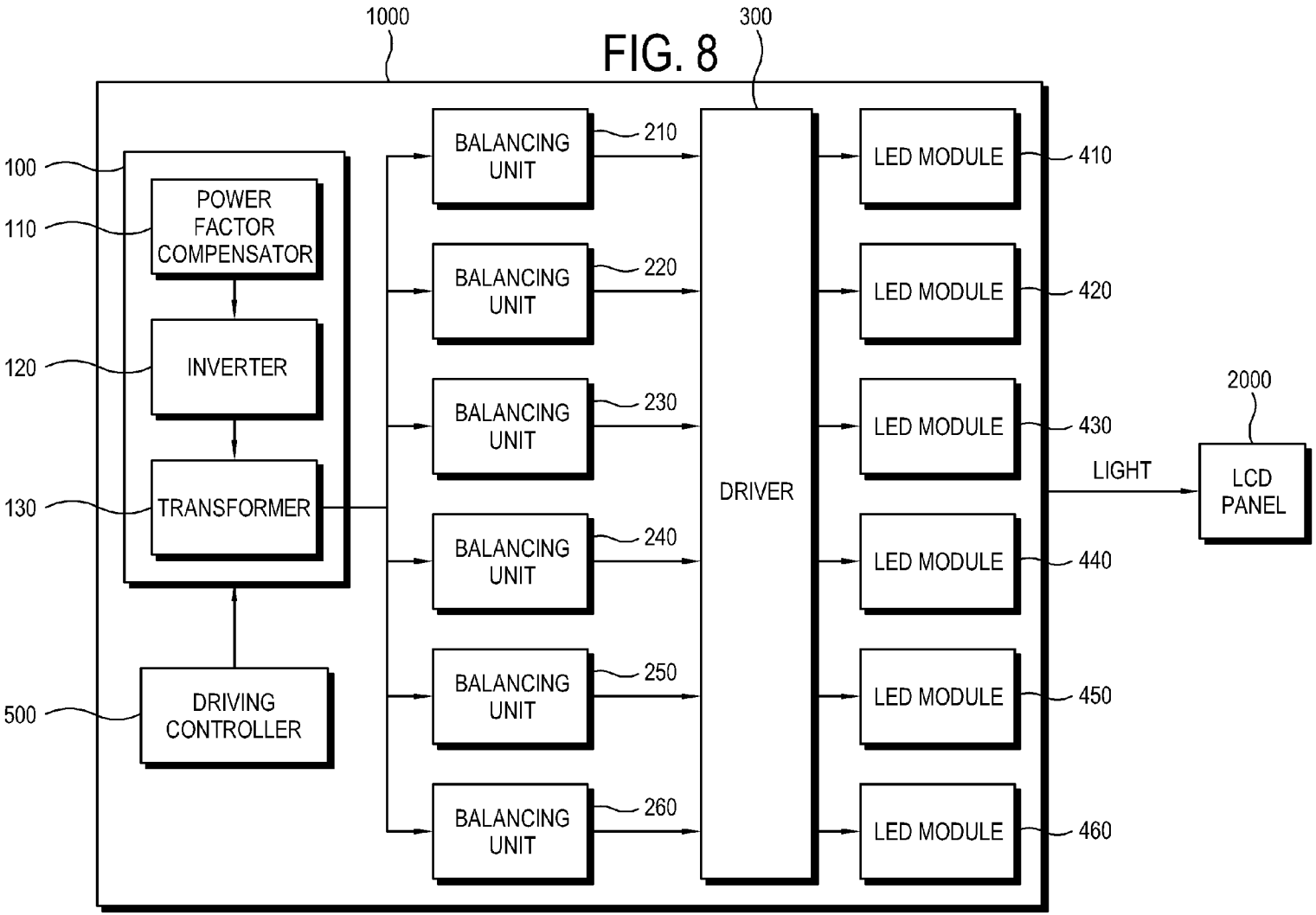
FIG. 8 is a control block diagram of a display apparatus according to an exemplary embodiment of the present inventive concept.

FIG. 8 is a control block diagram of a display apparatus according to an exemplary embodiment of the present inventive concept. Referring to FIG. 8, the display apparatus includes a backlight assembly 1000 and a liquid crystal display (LCD) panel 2000. The display apparatus may include any of the backlight assemblies shown in FIGS. 2 to 7.

The backlight assembly 1000 is disposed in a rear surface of the LCD panel 2000 and emits light to the LCD panel 2000. Since the backlight assembly 1000 includes an LED module as a point light source, the backlight assembly 1000 may perform scanning driving by applying a PWM control signal to each of the LED modules, and may perform a local dimming by arranging the LED modules corresponding to a particular area of the LCD panel 2000. That is, a brightness control which considers an image signal displayed on the LCD panel 2000 is available. The backlight assembly 1000 according to the exemplary embodiment has simpler hardware and control configuration and contributes to downsizing the display apparatus.

If the display apparatus includes a monitor which is connected to a computer system, the display apparatus may not include a power factor compensator 110 in the power unit 100 of the backlight assembly 1000. If an adaptor which is connected to a commercial AC power terminal is used to supply power to the monitor, the power factor compensator 110 may be included in the adaptor rather than the monitor.

Figure 9:
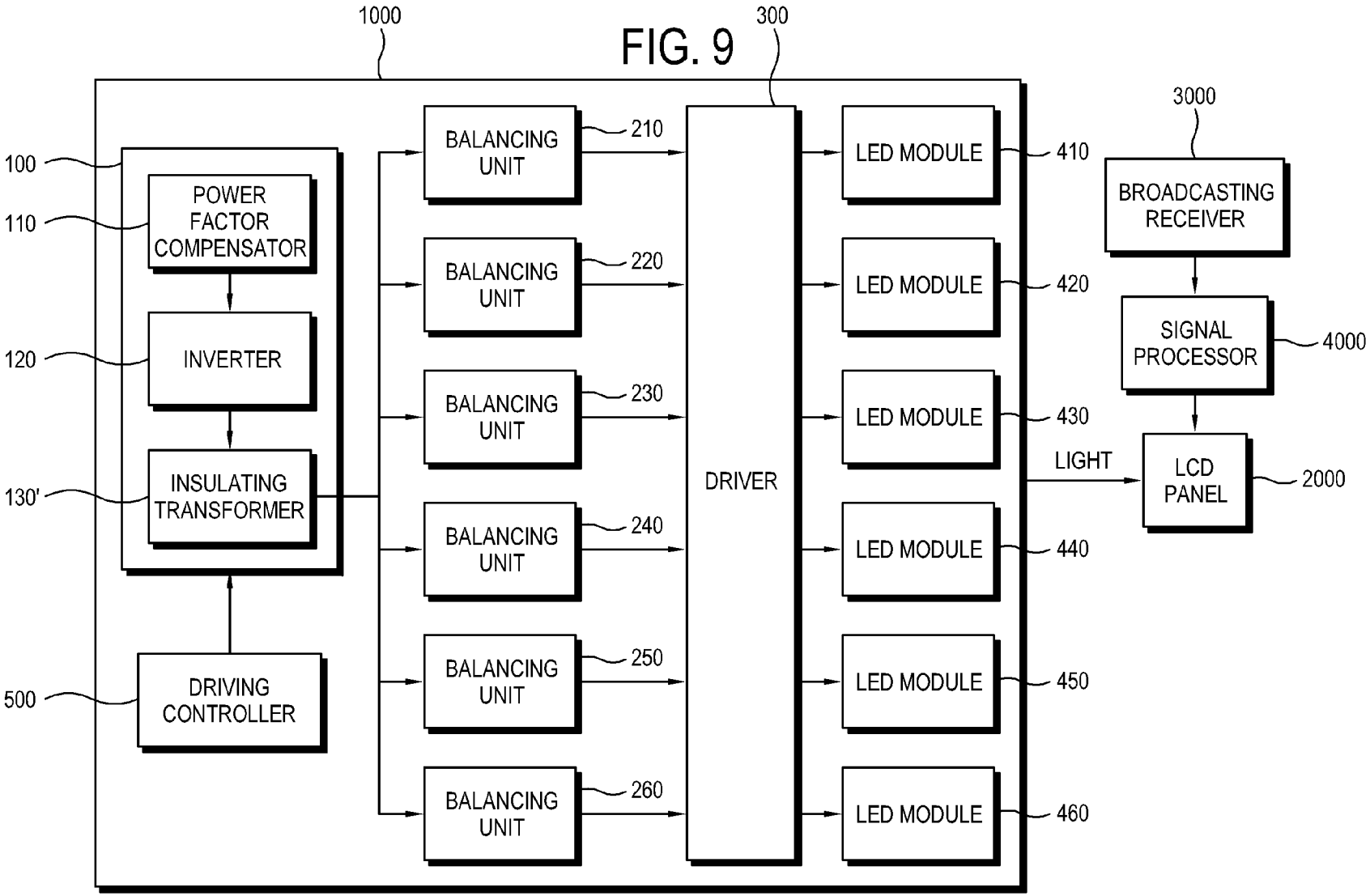
FIG. 9 is a control block diagram of a television according to an exemplary embodiment of the present inventive concept.

FIG. 9 is a control block diagram of a television (TV) according to an exemplary embodiment of the present inventive concept. Referring to FIG. 9, the TV further includes a broadcasting receiver 3000 and a signal processor 4000.

The broadcasting receiver 3000 tunes a channel frequency and receives a broadcasting signal from the channel. The broadcasting receiver 3000 includes a channel detection module (not shown) and an RF demodulation module (not shown).

The signal processor 4000 processes a broadcasting signal received from the broadcasting receiver 3000 and displays the broadcasting signal on the LCD panel. The signal processor 4000 includes a demultiplexer (not shown), a video decoder (not shown), and an audio decoder (not shown). A current which is output by the power unit 100 may be supplied to the broadcasting receiver 3000 and the signal processor 4000. The power unit 100 may further include a power converter (not shown) which converts a current output by the power factor compensator 110 to a power level necessary for the signal processor 4000 which processes the broadcasting signal.

The TV should be insulated from a commercial AC power terminal to secure electric safety. According to the present exemplary embodiment, the power unit 100 includes an insulating transformer 130' whose primary end and a secondary end are insulated from each other. If the insulation configuration is not required, the transformer may not include an insulating transformer 130' or an insulation configuration may apply to components other rather than the transformer. Like the display apparatus, the backlight assembly may supply light, which is partially different in brightness or color, to the LCD panel 2000 displaying a broadcasting signal thereon.

As described above, according to aspects of the present inventive concept, a backlight assembly, and a display apparatus and a television comprising the same are more efficient and slimmer. Also, according to aspects of the present inventive concept, a backlight assembly, and a display apparatus and a television comprising the same have a simple control configuration. Further, according to aspects of the present inventive concept, a backlight assembly, and a display apparatus and a television comprising the same reduce manufacturing costs by decreasing the number of components used.

Although a few exemplary embodiments of the present invention have been shown and described, it will be appreciated by those skilled in the art that changes may be made in these exemplary embodiments without departing from the principles and spirit of the invention, the scope of which is defined in the appended claims and their equivalents.

What is claimed is:

1. A display apparatus, comprising:

a liquid crystal display (LCD) panel which displays an image thereon; and a backlight assembly which emits light to the LCD panel, wherein the backlight assembly comprises:

a power unit which outputs a current whose polarity is changed on a regular basis;

a plurality of balancing units which is connected in parallel to the power unit;

a plurality of LED modules which individually receives each current output by one of the plurality of balancing units; and a driver which is connected between the plurality of balancing units and the plurality of LED modules, and forms a current route for each balancing unit to balance a current supplied to two different LED modules during a single period where the polarity of the current output by the power unit is changed, wherein each of the plurality of light emitting diode (LED) modules comprises a plurality of LEDs, and wherein the driver comprises: a first diode line which forms a first current route supplying a current output by a first end of the transformer to a first LED module if the current output by the power unit is positive; and a second diode line which forms a second current route supplying a current output by a second end of the transformer to a second LED module if the current output by the power unit is negative.

2. The display apparatus according to claim 1, wherein the current supplied to the plurality of LED modules is equally balanced during the single period where the polarity of the current output by the power unit is changed.

3. The display apparatus according to claim 2, wherein the power unit comprises:

a power factor compensator which compensates for a power factor of primitive power;

an inverter which converts a direct current whose power factor is compensated for, into an alternating current; and a transformer which transforms the alternating current as a primary current into a secondary current.

4. The display apparatus according to claim 3, wherein the plurality of balancing units comprises a balancing capacitor which is connected to at least a first end of a secondary coil included in the transformer.

5. The display apparatus according to claim 3, wherein the inverter is a half bridge type or a full bridge type.

6. The display apparatus according to claim 3, wherein the plurality of balancing units is connected in parallel to a single secondary coil included in the transformer.

7. The display apparatus according to claim 3, wherein the plurality of balancing units is connected to a plurality of secondary coils included in the transformer.

8. The display apparatus according to claim 1, further comprising a driving controller which detects a current flowing in the plurality of LED modules, generates a control signal to control the detected current to become a predetermined reference current, and outputs the control signal to the power unit.

9. The display apparatus according to claim 8, wherein the driving controller performs a variable frequency control or a fixed frequency control.

10. The display apparatus according to claim 1, further comprising:

a broadcasting receiver which receives a broadcasting signal; and a signal processor which processes the received broadcasting signal.

11. The display apparatus according to claim 10, wherein the transformer comprises an insulating transformer.

12. A display apparatus, comprising:

a liquid crystal display (LCD) panel which displays an image thereon; and a backlight assembly which emits light to the LCD panel, the backlight assembly comprising:

a power unit which outputs a current whose polarity is changed on a regular basis, a plurality of balancing units which is connected in parallel to the power unit, and each of which receive and balance the current output by the power unit and supplied to two different LED modules, a plurality of LED modules each of which individually receive the respective current output by a corresponding balancing unit of the plurality of balancing units, and a driver which is connected between the plurality of balancing units and the plurality of LED modules, and which forms a current route for each of the plurality of balancing unit to balance the current supplied to the two different LED modules among the plurality of LED modules during a single period where the polarity of the current output by the power unit is changed, wherein each of the plurality of light emitting diode (LED) modules comprises a plurality of LEDs, and wherein the driver comprises: a first diode line which forms a first current route supplying a current output by a first end of the transformer to a first LED module of the plurality of LED modules if the current output by the power unit is positive; and a second diode line which forms a second current route supplying a current output by a second end of the transformer, different from the first end, to a second LED module, of the plurality of LED modules, different from the first LED module, if the current output by the power unit is negative.

13. The display apparatus according to claim 12, wherein the plurality of balancing units equally balance the current during the single period where the polarity of the current output by the power unit is changed.

14. The display apparatus according to claim 13, wherein:

the power unit comprises:

a power factor compensator which compensates for a power factor of input primitive power, an inverter which converts a direct current whose power factor is compensated for by the power factor compensator, into an alternating current, and a transformer which transforms the alternating current as a primary current into a secondary current, and which comprises a secondary coil; and the plurality of balancing units each comprise a balancing capacitor which is connected to at least a first end of the secondary coil.

15. A television, comprising:

a broadcasting receiver which receives a broadcasting signal;

a signal processor which processes the received broadcasting signal;

a liquid crystal display (LCD) panel which displays the processed broadcasting signal thereon; and a backlight assembly which emits light to the LCD panel, the backlight assembly comprising:

a power unit which outputs a current whose polarity is changed on a regular basis, a plurality of balancing units which is connected in parallel to the power unit, and each of which receive and balance the current output by the power unit and supplied to two different LED modules, a plurality of light emitting diode (LED) modules each of which individually receive the respective current output by a corresponding balancing unit of the plurality of balancing units, and a driver which is connected between the plurality of balancing units and the plurality of LED modules, and which forms a current route for each of the plurality of balancing units to balance the current supplied to the two different LED modules among the plurality of LED modules during a single period where the polarity of the current output by the power unit is changed, wherein each of the plurality of light emitting diode (LED) modules comprises a plurality of LEDs, and wherein the driver comprises: a first diode line which forms a first current route supplying a current output by a first end of the transformer to a first LED module of the plurality of LED modules if the current output by the power unit is positive; and a second diode line which forms a second current route supplying a current output by a second end of the insulating transformer, different from the first end, to a second LED module of the plurality of LED modules, different from the first LED module, if the current output by the power unit is negative.

16. The television according to claim 15, wherein the plurality of balancing units equally balance the current during the single period where the polarity of the current output by the power unit is changed.

17. The television according to claim 16, wherein the power unit comprises:

a power factor compensator which compensates for a power factor of input primitive power;

an inverter which converts a direct current, whose power factor is compensated for by the power factor compensator, into an alternating current; and an insulating transformer which transforms the alternating current as a primary current into a secondary current.

18. The television according to claim 17, wherein:

the insulating transformer comprises a secondary coil; and the plurality of balancing units each comprise a balancing capacitor which is connected to at least a first end of the secondary coil.

19. A method of balancing a current supplied to a plurality of light emitting diode (LED) modules of a backlight assembly, the method comprising:

receiving, by a plurality of balancing units connected in parallel to a power source, a current whose polarity is changed on a regular basis from the power source;

supplying, by each of the plurality of balancing units, the current to two different LED modules, respectively, among the plurality of LED modules during a single period where the polarity of the current is changed, wherein each of the balancing units supplies the current to one of the two different LED modules when the polarity of the current is positive and an other of the two different LED modules when the polarity of the current is negative, wherein each of the plurality of light emitting diode (LED) modules comprises a plurality of LEDs.

* * * * *